United States Patent [19]

Landa

[11] 4,368,881

[45] Jan. 18, 1983

[54] FRICTION PAPER FEEDER

[75] Inventor: Benzion Landa, Edmonton, Canada

[73] Assignee: Savin Corporation, Valhalla, N.Y.

[21] Appl. No.: 325,601

[22] Filed: Nov. 27, 1981

Related U.S. Application Data

[63] Continuation of Ser. No. 52,405, Jun. 27, 1979, abandoned.

[51] Int. Cl.[3] ..... B65H 3/52

[52] U.S. Cl. ..... 271/122; 271/125; 192/56 C

[58] Field of Search ..... 271/122, 125, 121, 34, 271/35; 414/123, 124, 129, 130; 192/56 C

[56] References Cited

U.S. PATENT DOCUMENTS

| | | | |
|---|---|---|---|
| 2,468,193 | 4/1949 | Goff | 192/56 C |
| 2,626,029 | 1/1953 | Gutterman | 192/56 C |
| 2,892,629 | 6/1959 | Osgood et al. | 271/122 |
| 3,754,754 | 8/1973 | Peterson | 271/122 |
| 3,857,559 | 12/1974 | McInerny | 271/122 |
| 3,957,366 | 5/1976 | Taylor et al. | 271/34 X |

*Primary Examiner*—Bruce H. Stoner, Jr.

*Attorney, Agent, or Firm*—Shenier & O'Connor

[57] ABSTRACT

Apparatus for individually feeding sheets in which a friction feed roller positively driven in the direction of feed opposes a friction retarding roller biased in the reverse direction with a predetermined torque and urged against the feed roller with a predetermined force. The reverse bias torque is regulated by means of a spring and a controllable clutch which is disengaged in response to a predetermined strain in the spring. The spring and controllable clutch may comprise a helical spring clutch. In another aspect of the disclosure, the retarding roller is carried by an arm for rotation about a pivot center located such that the normal force urging the two rollers together is automatically suitably adjusted in response to changes in the biasing torque.

5 Claims, 13 Drawing Figures

74
76
78
22
108
42
72
110
106
30
104
84
82
90
80
94
88
92
86
96
98
100
102
68
16
15
36
28
2
2
40
22
70
52

10
50
14
48
22
46
18
34
26
24
38
32
2
60
44
2
56
58
12
54
22

FRICTION PAPER FEEDER

This is a continuation of application Ser. No. 052,405, filed June 27, 1979, now abandoned.

BACKGROUND OF THE INVENTION

This invention relates to friction paper feeders and, in particular, friction paper feeders used to supply either originals or copy sheets to an electrostatic copier.

Various arrangements of friction rollers or belts have been used in an attempt to insure the reliable feeding of a sheet from a stack while at the same time preventing the feeding of more than one sheet at a time. One type of paper feeder of the prior art, operating on the differential friction principle, employs a driven feed roller opposing a retarding roller driven in an opposite direction at their point of contact. The feed roller surface has a relatively high coefficient of friction with paper, while the retarding roller surface has a coefficient of friction with paper less than that of the feed roller but greater than that between two successive sheets of paper.

In order for feeders of this type to operate satisfactorily, the coefficient of friction of the feed roller with paper must always exceed that of the retarding roller, which in turn must always exceed the coefficient of friction between two sheets of paper. After some period of use, however, even rollers having a high initial coefficient of friction become coated with fibers from the paper and their coefficient of friction drops down to about unity. Since the coefficient of friction between successive sheets of paper can be as high as 0.7, there is very little latitude for permissible variation in the coefficient of friction of the retarding roller and unreliable operation may result.

In still another type of friction feeder known to the art, rather than having two rollers of different coefficients of friction, opposing rollers both having high coefficients of friction are used. The feed roller is positively driven in a forward direction, but the retarding roller, rather than being driven at a constant reverse velocity, is subjected to a predetermined reverse torque. The retarding roller is free, however, to rotate in a forward direction if the externally applied torque is sufficient to overcome this predetermined torque. The predetermined torque applied to the retarding roller is selected so that it is sufficient to separate two sheets of paper in the nip but is insufficient to overcome the frictional force between either roller and a contacting sheet of paper.

Thus, if only a single sheet of paper is presented to the roller nip, the feed roller not only advances the sheet of paper but also overcomes the predetermined torque and causes the retarding roller to rotate in a forward direction. If, however, two sheets of paper are presented to the roller nip, the feed roller will continue to advance the first sheet, but the reverse torque applied to the retarding roller separates the two sheets of paper and thereafter moves the second sheet rearwardly out of the nip.

Osgood et al. U.S. Pat. No. 2,892,629 shows a feeder of this type using a torsion spring in combination with a friction clutch to bias the retarding roller using energy derived from the feed roller through frictional engagement. Van Dalen et al. U.S. Pat. Nos. 3,272,500, Breuers 3,044,770, and Gibson 4,060,232 show similar arrangements in which the retarding roller is driven from an independent energy source through a friction clutch which decouples at the desired level of torque.

Feeders of this type have the advantage over differential friction feeders that the coefficient of friction of the retarding roller can be as high as practical and need not be less than the friction of the feed roller. The only constraint on the coefficients of friction is that each roller have a coefficient of friction with paper that is greater than the coefficient of friction between two sheets of paper. Because of this relaxed requirement, the reliability of feed is substantially increased.

One drawback shared by feeders of the type disclosed in the Osgood et al. patent, in which a spring cocked by the feed roller supplies the reverse torque to the retarding roller, is the dependence of the reverse torque on the degree to which the spring is wound. Because of this dependence, which is generally linear, some period will elapse following initial actuation of the rollers before the spring is sufficiently tensioned to supply the desired torque. If two or more sheets enter the roller nip before this period has elapsed, unreliable operation may result. Any attempt to shorten the initial period by lowering the spring compliance will effect a corresponding shortening of the "throw" of the retarding roller at the desired reverse torque, also leading to unreliable operation.

Another drawback, shared by all of the feeders disclosed in the above-identified patents, is the dependence of the reverse torque on the frictional characteristics of the friction clutches used. As the working surfaces become worn, their frictional characteristics may change, and operation may become unreliable.

SUMMARY OF THE INVENTION

One of the objects of my invention is to provide a sheet feeder which operates reliably even after a long period of use.

Another object of my invention is to provide a sheet feeder which does not require an excessive period to become operative after initial actuation.

Still another object of my invention is to provide a sheet feeder which fully ejects a second sheet.

A further object of my invention is to provide a sheet feeder which does not rely on the characteristics of frictional surfaces for its operation.

A further object of my invention is to provide a sheet feeder using a reverse-biased retarding roller which is relatively insensitive to changes in the value of the reverse biasing torque.

Other and further objects of my invention will be apparent from the following description.

In one aspect, my invention contemplates a sheet feeder in which the normal force urging the feed roller and the retarding roller together is automatically adjusted in response to changes in the biasing torque, preferably in such a manner that the ratio $r\Delta N/\Delta\tau$ is greater than approximately 0.40, where $\Delta N$ and $\Delta\tau$ are changes in normal force and torque, respectively, and r is the radius of the retarding roller. Preferably, the coupling of normal force to biasing torque is achieved by mounting the retarding roller for movement against the feed roller along a path forming an acute angle with the plane containing the axis of the two rollers. This mounting is in turn preferably achieved by mounting the retarding roller for movement about a pivot axis spaced from the first plane and from the plane of tangency of the two rollers.

By adjusting the normal nip force a significant amount in response to changes in the biasing torque, I greatly increase the reliability of the roller assembly by decreasing its sensitivity to fluctuations in biasing torque such as the type described above. In assemblies of the prior art, by contrast, any coupling between the nip force and biasing torque is unintentional and in any case insignificant, and such fluctuations may easily result in feeder malfunction.

In another aspect, my invention contemplates a sheet feeder in which a friction feed member positively driven in the direction of feed opposes a friction retarding member biased in the reverse direction with a predetermined torque. The reverse torque is regulated by means of a spring clutch in which a helical torsion spring is coupled to a driven clutch member at the other end. The free end of the spring wraps around the driver clutch member in response to an externally applied torque in the drive direction of the clutch but is arrested when it rotates through a predetermined angular displacement in that direction relative to the other spring end to decouple the spring from the driver clutch member.

Owing to the slight frictional coupling between the free end of the clutch spring and the driver clutch member, the spring end grabs the clutch member as it is rotated in the drive direction. As the clutch spring is further wound, the free end progressively wraps down on the driver clutch member so as to generate a frictional grabbing force just sufficient to overcome the return force of the clutch spring. When the free end coils a sufficient extent relative to the other spring to abut the disengagement pin, the free end begins to slip relative to the driver clutch member so that, at equilibrium, the clutch spring abuts the disengagement pin while slipping constantly relative to the driver clutch member.

Since the frictional force between the clutch spring and the driver clutch member is determined solely by the clutch spring return force, which in turn is determined solely by the angular spring displacement, the assembly described above operates as a slipping clutch in which the slippage point is determined by spring forces rather than the surface characteristics of the slipping members. As a result, it is possible to supply the retarding roller with a predetermined reverse torque with a high degree of accuracy and reliability.

In yet another aspect, my invention contemplates a sheet feeder in which the retarding roller is biased in the reverse direction with a predetermined force by means of a spring having a stop or other means for subjecting the spring to a predetermined displacement in the absence of any externally applied force from the retarding roller. Thus, in the feeder contemplated, the reverse biasing spring is already wound to provide a biasing force approximating the desired biasing force even with very little additional spring displacement.

BRIEF DESCRIPTION OF THE DRAWINGS

In the accompanying drawings to which reference is made in the instant specification and in which like reference characters are used to indicate like parts in the various views.

DETAILED DESCRIPTION OF THE PREFERRED EMBODIMENTS

Figure 1A:
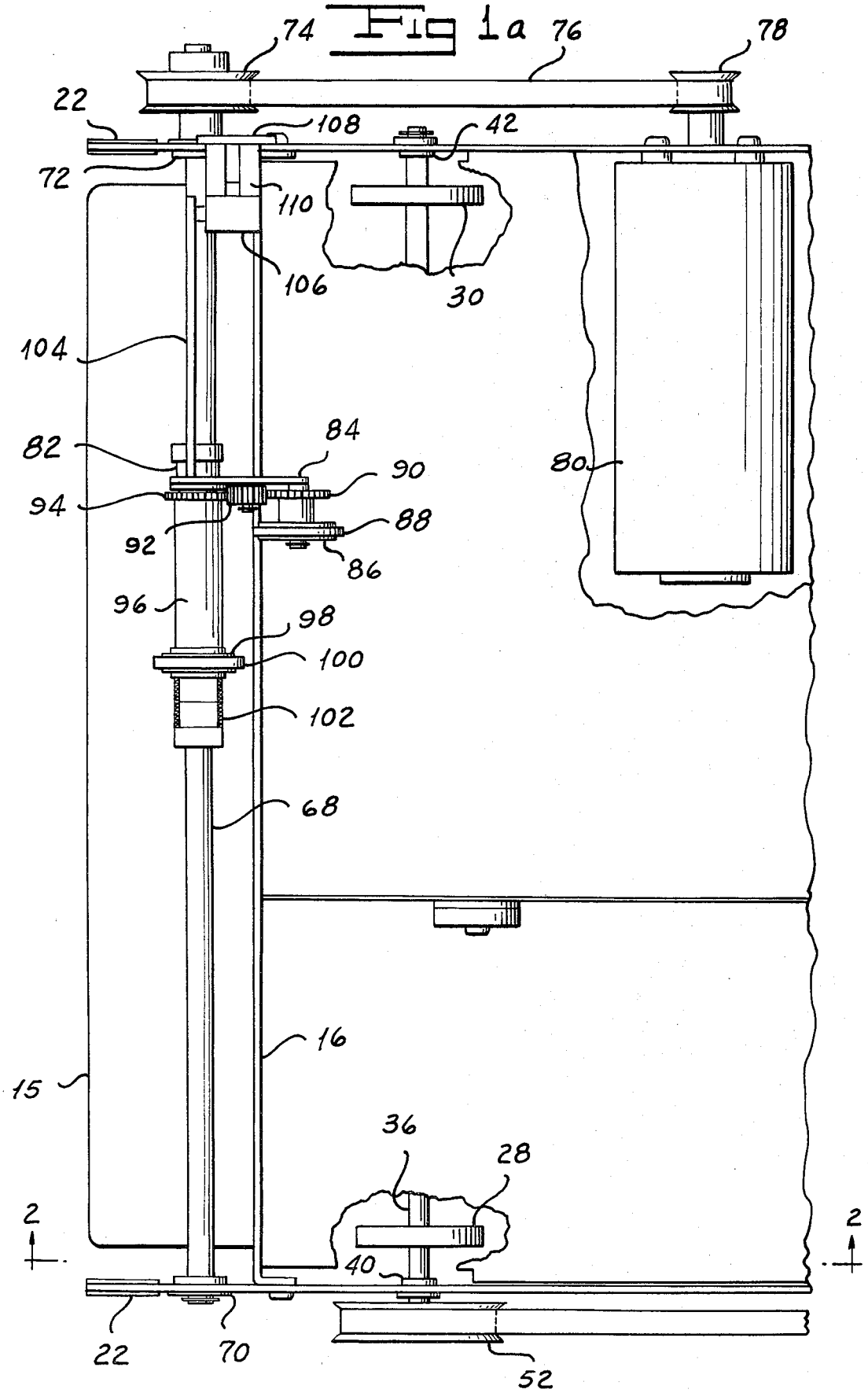
FIG. 1*a* is a fragmentary top plan of the front portion of one embodiment of my feeder.
Figure 1B:
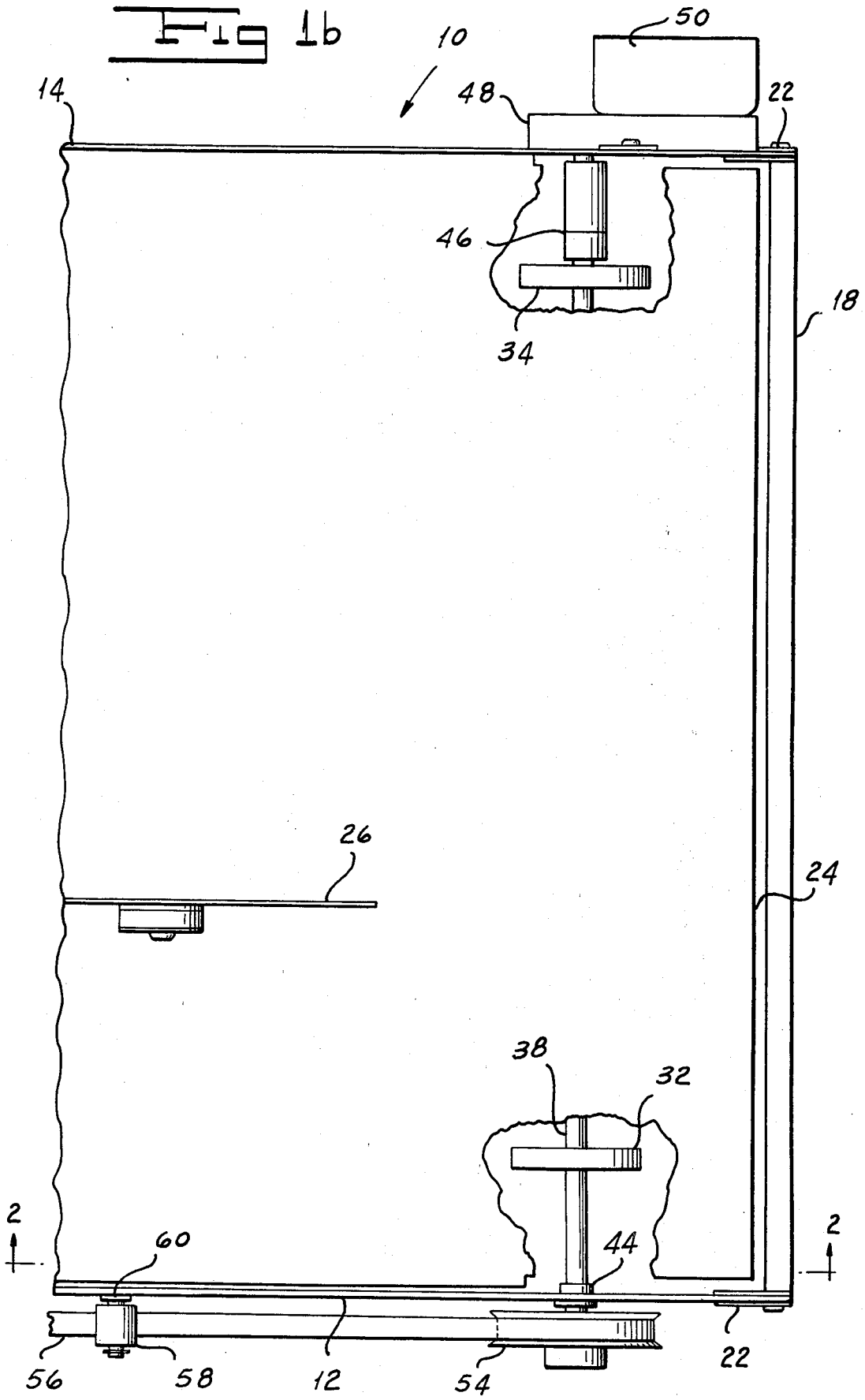
FIG. 1*b* is a fragmentary top plan of the rear portion of the feeder shown in FIG. 1*a*.

Referring now to FIGS. 1*a* to 4, a first embodiment of my sheet feeder employs a torsion spring to bias the retarding roller in a reverse direction. The feeder, indicated generally by the reference numeral 10, includes respective right and left sidewalls 12 and 14 joined adjacent to front ends thereof by a front wall 16 and adjacent to the rear ends thereof by vertically spaced rods 18 and 20. Feet 22 carried at the front and rear ends of each of the sidewalls 12 and 14 space the feeder 10 slightly from the surface (not shown) on which it rests. A vertically movable sheet-receiving platform 24 extending generally between sidewalls 12 and 14 supports a stack S of sheets of paper or the like to be fed. A lower sheet guide 15 extends forwardly from the front wall 16 at a level just below the top of the stack S. If desired, the platform 24 may include a longitudinally extending edge guide 26 against which one side of the stack S may be aligned. Guide 26 may be adjustably positioned laterally of the feeder 10 to accommodate sheets of different widths.

A transversely spaced pair of front cams 28 and 30 carried by a camshaft 36 support the platform 24 adjacent to its front end, while a similar pair of rear cams 32 and 34 carried by a camshaft 38 support the platform 24 adjacent to its rear end. Shaft 36 is rotatably received by bearings 40 and 42 carried respectively by sidewalls 12 and 14. One end of shaft 36 extends beyond sidewall 12 to receive a pulley 52. One end of shaft 38 extends through a bearing 44 carried by sidewall 12 to receive a pulley 54. A friction clutch 46 couples the other end of shaft 38 through a gear box 48 to a motor 50 mounted outboard of sidewall 14. A belt 56 tensioned by a pulley 58 couples pulleys 52 and 54. Tension pulley 58 is supported on a bracket 60 formed with a vertical slot 62 which receives a guide pin 64 carried by sidewall 12 as well as a screw 66 threadably received by sidewall 12 to permit vertical adjustment of pulley 58 and thus the tension in belt 56.

Bearings 70 and 72 carried respectively by sidewalls 12 and 14 rotatably support a feed roller shaft 68 at a location near the front end of the feeder 10. Shaft 68 extends beyond sidewall 14 to receive a pulley 74 coupled by a belt 76 to a second pulley 78 carried by the shaft of motor 80 mounted inboard of sidewall 14. One arm of a bell crank 84 rotatably mounted on shaft 68 by a bearing 82 rotatably supports a pick-off roller 86 having a high-friction working surface 88. A gear 90 rotatable with pick-off roller 86 meshes with an intermediate gear 92 carried by bell crank 84. Gear 92 meshes with a drive gear 94 which is carried by a sleeve 96 rotatably mounted on shaft 68. Sleeve 96 carries a feed roller 98 having a friction surface 100. A one-way clutch 102 couples shaft 68 to sleeve 96 to drive feed roller 98 and gear 94 positively in a clockwise direction as seen in FIG. 2, while at the same time permitting these members to be overdriven if the sheets are taken up by a subsequent pair of rollers (not shown).

The other arm of bell crank 84 carries a pin 104 which, in response to downward movement of pick-off roller 86, strikes the actuating member of a microswitch 106. I mount microswitch 106 on spacers 110 carried by a bracket 108 mounted on sidewall 14. Pin 104 and microswitch 106 form a part of a servo system for maintaining the top end of the stack S at a proper level for feeding sheets therefrom. As sheets are fed from the top of the stack, pick-off roller 86, under the influence of gravity, drops down to a level below the desired equilibrium level. This in turn causes pin 104 to pivot clockwise around shaft 68 and actuate switch 106. Switch 106 in turn controls camshaft motor 50 which, when energized, rotates each of the camshafts 28, 30, 32 and 34 clockwise as shown in FIG. 2 to raise the level of stack S. When the stack S rises to the predetermined equilibrium level, pin 104 moves away from switch 106, breaking the circuit and deactuating motor 50.

Figure 2:
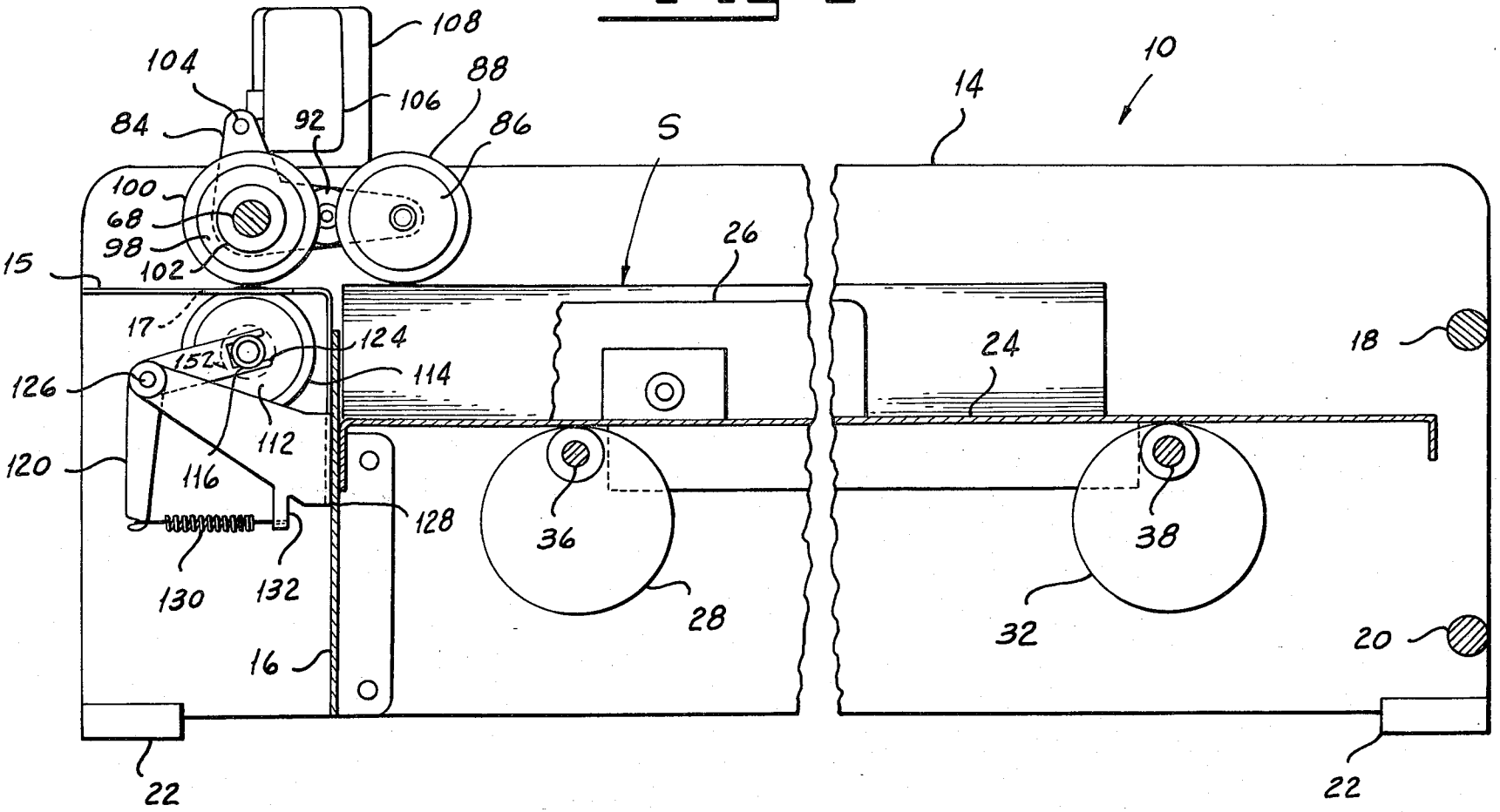
FIG. 2 is a fragmentary section of the feeder shown in FIGS. 1*a* and 1*b*, taken along line 2—2.
Figure 3:
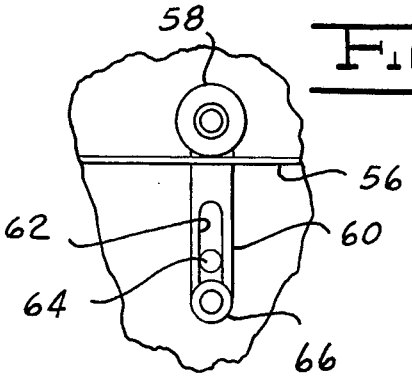
FIG. 3 is a fragmentary right side elevation of the tension pulley of the feeder shown in FIGS. 1*a* and 1*b*.
Figure 4:
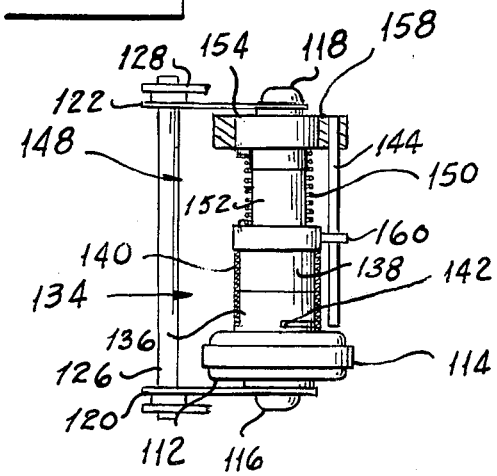
FIG. 4 is a fragmentary top plan of the retarding roller assembly of the feeder shown in FIGS. 1*a* and 1*b*.

Referring now to FIGS. 2 and 4, my feeder 10 includes a retarding roller 112 having a high-friction working surface 114. Roller 112 is free to rotate on an axis defined by end screws 116 and 118, which are adjustably received in slots 124 formed in arms of respective bell cranks 120 and 122. A pivot pin 126 supported by spaced arms of a bracket 128 secured to wall 16 rotatably supports the bell cranks 120 and 122. Helical tension springs 130 disposed between the other arms of bell cranks 120 and 122 and extensions 132 on the arms of bracket 128 bias the retarding roller 112 upwardly through a slot 17 formed in guide 15 into engagement with the drive roller 98. Retarding roller 112 carries for rotation therewith the driver member 136 of a spring clutch indicated generally by the reference numeral 134. The driven member 138 of the spring clutch 134 fixedly supports one end of a helical torsion spring 140, the other end of which wraps around driver member 136 and has a radially outwardly directed extension 142.

Spring 140 is so wound as normally to wrap around the driver member 136 in a counterclockwise direction as viewed in FIG. 2 to couple the driver 136 to the driven member 138 when roller 112 rotates in a counterclockwise direction. When retarding roller 112 is driven in a clockwise direction as viewed in FIG. 2, clutch 134 is disengaged.

Driven member 138 of spring clutch 134 carries for rotation therewith the mandrel 152 of a torsion spring assembly indicated generally by the reference numeral 148. A helical coil 150 surrounding mandrel 152 is attached to the mandrel at one end and to a stationary cylindrical member 154 at the other end thereof. As may be seen in FIG. 4, coil 150 is larger in diameter than the mandrel 152 to permit the coil to wind down in response to an externally applied torque.

Stationary member 154 carries a collar 158 having an axially extending finger 144. In assembling my device, I prewind spring 150 in a counterclockwise direction to provide an initial bias torque. A lug 160 on mandrel 152 engages finger 144 to hold the bias torque. Preferably, the collar 158 is adjustable around stationary member 154 to vary the amount of bias torque.

In my system, the force with which springs 130 urge roller 112 into engagement with roller 98 and the torque applied to shaft 68 are such that, with the rollers in direct engagement or with only a single sheet of paper between the rollers, roller 112 is driven in a counterclockwise direction as shown in FIG. 2 with a torque sufficient to overcome the initial biasing torque in spring 150. When roller 112 is driven under these conditions, driver member 136 is clutched to driven member 138 to drive mandrel 152 in a counterclockwise direction as viewed in FIG. 2 further to wind spring 150 down on the mandrel to increase the reversing torque. After a predetermined rotation of the engaged clutch in the counterclockwise direction such, for example, as three-quarters of a revolution, end 142 of spring 140 strikes finger 144 and the clutch releases.

Having the operation just described in mind, and assuming that two sheets of paper enter the nip between rollers 98 and 112 at the same time, the paper-to-paper friction between the two sheets will be much less than the roller-to-paper friction between the upper and lower rollers and the respective upper and lower sheets. As a result, the torque tending to drive roller 112 in a counterclockwise or feeding direction will be less than the torque stored in spring 150. As a result, under the action of spring 150, the roller 112 will reverse its direction of rotation and rotate in a clockwise direction as viewed in FIG. 2 to drive the lower of the double fed sheets out of the nip between rollers 98 and 112. When that is done, normal operation is restored.

Figure 5:
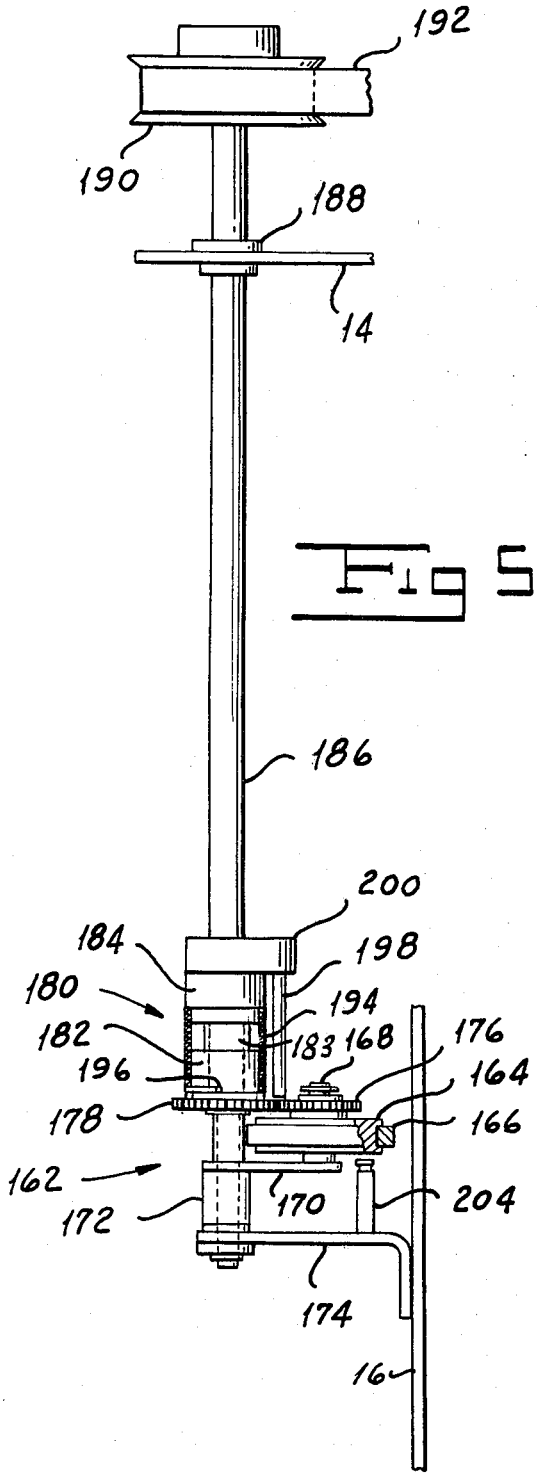
FIG. 5 is a fragmentary top plan of an alternative retarding roller assembly for the feeder shown in FIGS. 1*a* and 1*b*.
Figure 6:
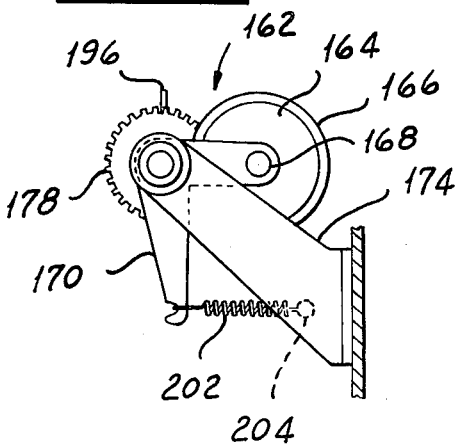
FIG. 6 is a right side elevation of the assembly shown in FIG. 5.

In FIGS. 5 and 6, I show a modified version of my feeder in which the retarding roller derives its reverse biasing torque from a continuously operating power source. In my modified feeder, indicated generally by the reference numeral 162, a bracket 174 mounted on the front wall of the feeder 162 rotatably supports one end of a shaft 186, the other end of which is rotatably supported in a bearing 188 on sidewall 14. Shaft 186 extends beyond sidewall 14 to receive a pulley 190 coupled by drive belt 192 to a suitable rotary power source (not shown) which drives shaft 186 in a counterclockwise direction as seen in FIG. 6. Such a power source may comprise an additional pulley carried by feed roller shaft 68 or, if desired, a separate motor.

A bell crank 170 rotatably supported by shaft 186 and axially spaced from bracket 174 by a spacer 172 carries a shaft 168 at the end of one arm thereof. Shaft 168 supports a retarding roller 164 having a high-friction working surface 166 and a roller gear 176 rotatable with roller 164. A helical tension spring 202 coupled between the other arm of bell crank 170 and a post 204 carried by bracket 174 biases retarding roller 164 upwardly against feed roller 98 with a predetermined biasing force.

Roller gear 176 meshes with a drive gear 178 rotatably supported by shaft 186. Drive gear 178 carries for rotation therewith the driver member 182 of a spring clutch indicated generally by the reference numeral 180. The driven member 184 of clutch 180 is carried by shaft 186 for rotation therewith and is spaced somewhat from the driver member 182 by a reduced portion 183 of either the driver member 182 or the driven member 184. A clutch spring 194 fixedly attached to the driven member 184 of spring clutch 180 extends around the driver member 182 in such a direction that counterclockwise rotation of the drive shaft 186 causes spring 194 to wrap around member 182 and to coil down along the reduced portion 183. When clutch spring 194 wraps around driver member 182 a predetermined extent, a pin 198 carried by a collar 200 fixedly carried by drive shaft 186 abuts a radially outwardly directed extension 196 of the free end of spring 194 to cause it to release from member 182 at a predetermined desired level of torque. Collar 200 is preferably adjustably mounted on clutch portion 184 to permit variation of the biasing force.

Spring clutch 180 thus serves to couple the counterclockwise-rotating shaft 186 to drive gear 178 to urge retarding roller clockwise up to a predetermined torque determined by the angular position of pin 198 on drive shaft 186. When no sheet or only a single sheet is in the nip between drive roller 98 and retarding roller 164, this predetermined torque is insufficient to overcome the torque supplied from the feed roller 98, and roller 98 frictionally drives roller 164 in a counterclockwise direction. When, however, two or more sheets enter the roller nip, the torque transmitted through the paper-to-paper interface is insufficient to overcome the predetermined biasing torque, and roller 164 rotates clockwise to drive the second sheet rearwardly out of the nip.

Figure 7:
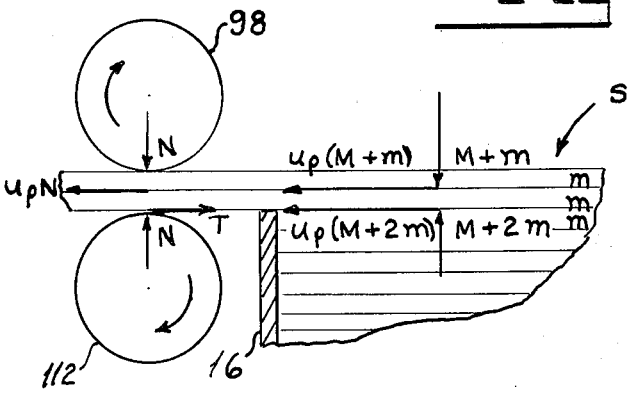
FIG. 7 is a schematic diagram of the forces acting on the lower of two sheets in the nip formed by the feed roller and retarding roller of the embodiment shown in FIGS. 1*a* to 4.

FIG. 7 shows the forces acting on the second, or lower, sheet when there are two sheets in the nip formed by rollers 98 and 112, and roller 112 is driving the lower sheet rearwardly out of the nip. At the nip itself, the lower roller 112 exerts a reverse tangential force T on the lower side of the sheet; the upper sheet exerts an oppositely directed shear force $u_pN$, where $u_p$ is the paper-to-paper coefficient of friction and N is the normal force urging rollers 98 and 112 together. At the stack S, the upper face of the second sheet is subjected to a forwardly directed shear force of $u_p(M+m)$, where M is the effective weight of the pick-off roller 86 and m is the effective weight of each sheet of paper in the stack S. Along its lower face, the second sheet is subjected to a forwardly directed shear force of $u_p(M+2m)$. The net reverse tangential force acting on the second sheet is thus:

$$F_t = T - u_pN - u_p(2M+3m) \quad (1)$$

To ensure reliable operation in this mode, then, roller 112 must be capable of exerting such a reverse tangential force T that:

$$T \geqq u_pN + u_p(2M+3m) \quad (2)$$

Or, considering T as given, the maximum permissible normal nip force N is given by the equation:

$$N \leqq T/u_p - (2M+3m) \quad (3)$$

Figure 8:
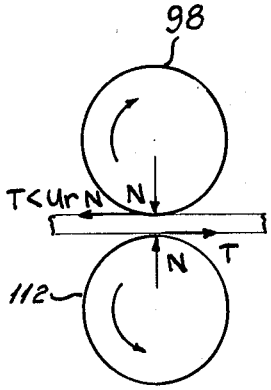
FIG. 8 is a schematic diagram of the forces acting on a single sheet in the nip formed by the rollers shown in FIG. 7.

FIG. 8 shows the forces acting on a single sheet in the roller nip in a mode of feeder operation in which the feed roller 98 is driving roller 112 forwardly against the action of its biasing torque. In this case, to avoid slippage between the sheet of paper and either of the rollers 98 and 112, the normal force N must be such that:

$$u_rN > T \quad (4)$$

where $u_r$ is the roller-to-paper coefficient of friction and $u_rN$ the maximum sustainable shear force. In terms of N:

$$N > T/u_r \quad (5)$$

Figure 9:
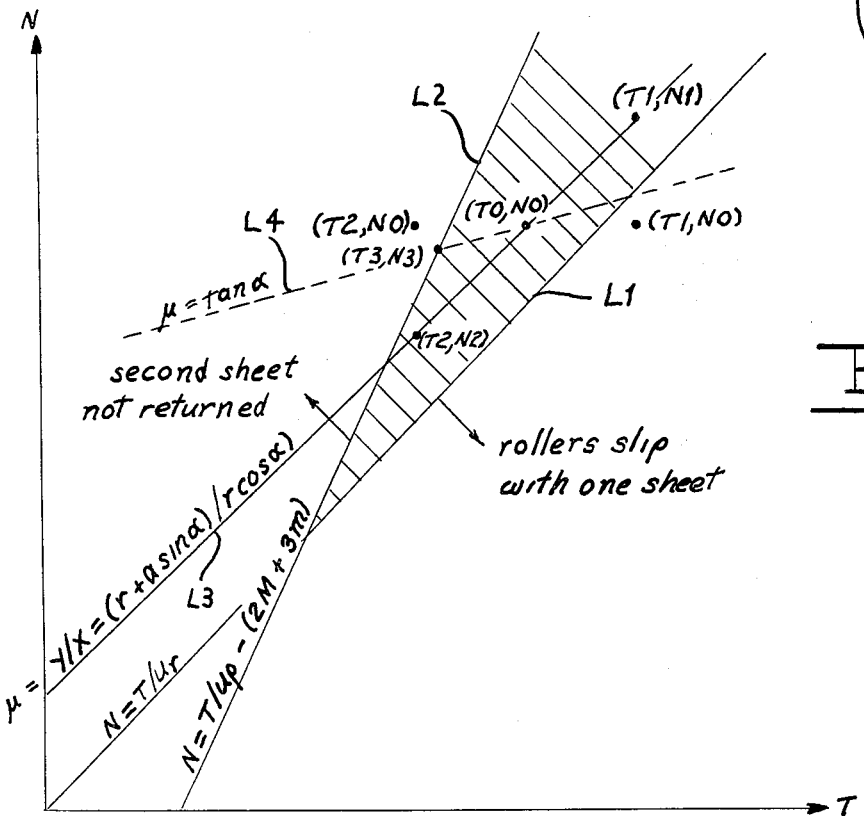
FIG. 9 is a plot of the various relationships between the normal nip force and the reverse tangential force exerted by the retarding roller of FIG. 7.

FIG. 9 is a plot, in which T is the x-coordinate and N the y-coordinate, showing the various relationships existing between the normal nip force N and the reverse tangential force T exerted by the retarding roller 112 shown in FIG. 7. In this figure, expressions (3) and (5) above define a shaped region of permissible values of T and N. If the point (T,N) is to the right of a line L1 along which $$N = T/u_r \quad (6)$$

then rollers 98 and 112 will slip with only one sheet therebetween. If, on the other hand, the point (T,N) is to the left of a line L2 along which $$N = T/u_p - (2M+3m) \quad (7)$$

the reverse tangential force T will be insufficient to return the second sheet.

Figure 10:
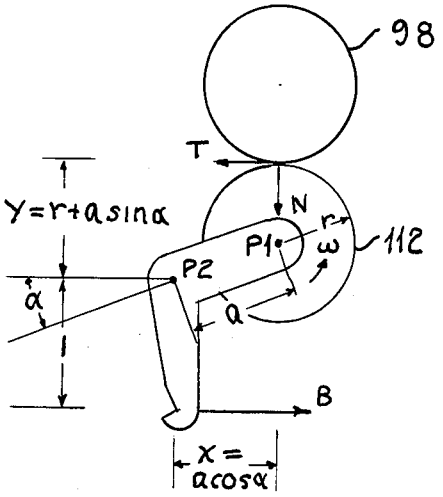
FIG. 10 is a schematic diagram of the forces producing moments about the pivot axis of the retarding roller shown in FIG. 7.

FIG. 10 is a force diagram of the moments acting about the pivot arm axis P2 of roller 112. In the diagram, a represents the spacing between the roller axis P1 and pivot axis P2, r is the radius of roller 112, B is the biasing force of spring 130, l is the lever arm of force B relative to axis P2, $\alpha$ is the angle between the line joining P1 and P2 and the plane of tangency of rollers 98 and 112, and $\omega$ is the counterclockwise angular velocity of roller 112.

To ascertain the dynamic relation between N and T as determined by the roller geometry, we must consider the most general situation in which roller 112 may be angularly accelerating. The angular momentum L of roller 112 about its own axis P1 is:

$$L = Iw \quad (8)$$

where I is the moment of inertia of roller 112. If P1 and P2 are fixed in space, it can be shown that the angular momentum of roller 112 about axis P2 is also equal to L.

The net counterclockwise torque about axis P2 is:

$$\tau = Bl + T(r + a\sin\alpha) - N(a\cos\alpha) \quad (9)$$

Since $\tau = dL/dt$, equations (8) and (9) yield:

$$Idw/dt = Bl + T(r + a\sin\alpha) - N(a\cos\alpha) \quad (10)$$

Figure 11:
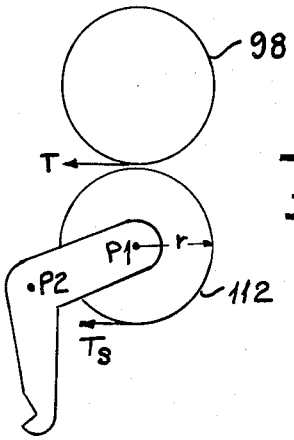
FIG. 11 is a schematic diagram of the forces producing moments about the rotation axis of the retarding roller shown in FIG. 7.

FIG. 11 is a force diagram of the moments acting about the axis P1 of retarding roller 112. In this figure, spring clutch 134 is assumed to be exerting a clockwise tangential force $T_s$ at a distance r from P1 to produce a torque of $T_sr$ about axis P1. Generalizing to the situation where the torque $T_sr$ supplied by spring clutch 134 is not necessarily equal to Tr, we obtain $$\tau_{P1} = Idw/dt = Tr - T_sr \quad (11)$$

Equations (10) and (11) may in turn be combined to yield:

$$B\mathrm{l}+T(r+a\sin\alpha)-N(a\cos\alpha)=Tr-T_s r \quad (12)$$

Solving for N, we obtain:

$$N=(B\mathrm{l}+T_s r+Ta\sin\alpha)/a\cos\alpha \quad (13)$$

The normal nip force N thus depends linearly on the spring force B, the supply torque $T_s$, and the instantaneous reverse tangential force T.

In the special case where the roller 112 is not accelerating angularly, as when a single sheet is being fed, T may be equated with $T_s$ and equation (13) simplified to:

$$N=(B\mathrm{l}+T_s(r+2\sin\alpha))/a\cos\alpha \quad (14)$$

Since r+a sin α and a cos α represent respectively the vertical displacement Y and the horizontal displacement X of the nip point relative to the pivot axis P2, equation (14) may be rewritten as:

$$N=(B\mathrm{l}+T_s Y)/X=B\mathrm{l}/X+T_s Y/X \quad (15)$$

FIG. 9 illustrates the relative insensitivity of my roller assembly to changes in the tangential force $T_s$ exerted by the spring clutch 134. It will be assumed that the spring force B is adjusted to produce a normal force of NO for a spring clutch force $T_s$ (generating a torque $T_s r$) of TO and that roller 112 is not accelerating so that $T_s=T$. In the non-accelerating situation, if $T_s$ varies, the point (T,N) will move to a new point lying along a line L3 passing through (TO,NO) and having a slope μ equal to Y/X. More specifically, if the spring clutch force $T_s$ increases to a new level T1, the normal force N will increase compensatingly to a new level N1 in accordance with equation (15), keeping the operating point (T1,N1) in the shaded region. By contrast, if the assembly had provided no interdependence between T and N, the new operating point (T1,NO) would be to the left of line L1, resulting in roller slippage in the single-sheet mode. In a similar manner, if the spring clutch force $T_s$ decreases to a level T2, the normal force N will decrease in a compensating manner to a level N2 in accordance with equation (15) to keep the operating point (T2,N2) in the shaded region. In this case, if N had remained constant, the shifted operating point would be to the right of line L2 and the reverse torque $T_s r$ would be insufficient to move a second sheet out of the roller nip.

It is apparent from FIG. 9 that the sensitivity of the assembly to changes in $T_s$ will be minimized if $\mu=Y/X$ is between approximately $1/u_r$ and $1/u_p$. In the embodiment shown in FIGS. 1*a* to 4, for $\alpha=15°$, a=20 mm, and r=13 mm, the slope μ is approximately 0.94. This constant of proportionality falls within these general limits, as in practice $u_p$ is about 0.5 and $u_r$ is about 1.0.

When two sheets are being fed, as in FIG. 7, the operating point (T,N) is somewhat different, since roller 112 is at least initially accelerating. In this mode, the reverse tangential force T drops to a value just equal to the drag forces in equation (1) so that:

$$T=u_p N+u_p(2M+3m) \quad (16)$$

In other words, the double-sheet operating point (T3,N3) lies along line L2. At the same time, T3 and N3 must satisfy equation (13). Accordingly, (T3,N3) lies on a line segment L4 originating at (T0,N0) and having a slope μ of tan α, as shown in FIG. 9. It will be apparent that α is subject to the constraint:

$$\tan\alpha<1/u_p \quad (17)$$

Otherwise the line L2 and the line segment L4 would not intersect and operation in this mode would be unstable.

Figure 12:
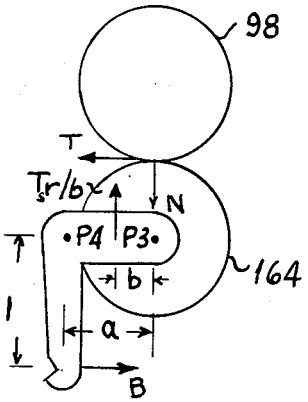
FIG. 12 is a schematic diagram of the forces producing moments about the pivot and rotation axes of the retarding roller shown in FIGS. 5 and 6.

FIG. 12 shows the forces acting on the roller assembly embodiment shown in FIGS. 5 and 6. The analysis of forces in this situation is similar to the above analysis (with α=0) except that the external origin of the spring clutch torque $T_s r$ must be taken in account. This torque may be considered as being applied at a point between the roller axis P3 and the pivot axis P4 at a distance b from P3 equal to the radius of gear 176. With this assumption, the net counterclockwise torque about P4 is:

$$\tau=Idw/dt=B\mathrm{l}+Tr-Na+T_s r(a-b)/b \quad (18)$$

Similarly, the net counterclockwise torque about P3 is:

$$=Idw/dt=Tr-T_s r \quad (19)$$

Combining equations (18) and (19) and solving for N:

$$N=(B\mathrm{l}=T_s r\,a/b)/a \quad (20)$$

Or, in incremental terms:

$$\Delta N/\Delta T_s=r/b \quad (21)$$

Assuming that r=13 mm, a=16 mm, and b=7 mm, we obtain $$\Delta N/\Delta T_s=1.86 \quad (22)$$

Again, this constant of proportionality falls within the limits referred to above.

It will be seen that I have accomplished the objects of my invention. My sheet feeder operates reliably even after a long period of use and does not rely on the characteristics of frictional surfaces for its operation. My sheet feeder can fully eject a second sheet without requiring an excessive period to become operative after initial actuation. Finally, my sheet feeder uses a reverse-biased retarding roller which is relatively insensitive to changes in the value of the reverse biasing torque.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for feeding sheets including in combination a feed roller, means for driving said feed roller in a certain direction of rotation, a retarding roller, an arm rotatably supporting said retarding roller, said arm being mounted on a pivot axis for movement of said retarding roller into and out of engagement with said feed roller, a rotary member disposed on said pivot axis, means carried by said arm for coupling said member to said retarding roller, and means for rotating said member in such a direction as to tend to rotate said retarding roller in said certain direction, one of said rotating means and said coupling means including means for limiting the torque transmitted to said retarding roller, said pivot axis being so located that said rotary member exerts a torque on said coupling means about said axis tending to urge said retarding roller into engagement with said feed roller.

2. Apparatus for feeding sheets including in combination a feed roller, means for driving said feed roller in a certain direction of rotation, a retarding roller, an arm rotatably supporting said retarding roller, said arm being mounted on a pivot axis for movement of said retarding roller into and out of engagement with said feed roller, a first gear mounted for rotation on said pivot axis, means including a second gear carried by said arm and engaging said first gear for coupling said first gear to said retarding roller, and means for rotating said first gear in such a direction as to tend to rotate said retarding roller in said certain direction, one of said rotating means and said coupling means including means for limiting the torque transmitted to said retarding roller, said pivot axis being so located that said first gear exerts a torque on said second gear about said axis tending to urge said retarding roller into engagement with said feed roller.

3. Apparatus for feeding sheets along a path including in combination a feed roller disposed on one side of said path, means for driving said feed roller in a certain direction of rotation, a retarding roller, an arm rotatably supporting said retarding roller, said arm being mounted on a pivot axis for movement of said retarding roller into and out of engagement with said feed roller on the other side of said path, a first gear mounted for rotation on said pivot axis, means including a second gear carried by said arm coaxially with said retarding roller and engaging said first gear for coupling said first gear to said retarding roller, and means for rotating said first gear in such a direction as to tend to rotate said retarding roller in said certain direction, one of said rotating means and said coupling means including means for limiting the torque transmitted to said retarding roller, said pivot axis being disposed at a location along said path downstream from said feed roller whereby said first gear exerts a torque on said second gear about said axis tending to urge said retarding roller into engagement with said feed roller.

4. Sheet feeding apparatus including in combination a feed roller, means for rotating the feed roller in a certain direction, a retarding roller, means mounting one of said rollers for movement into and out of engagement with the other of said rollers, and means for tending to rotate the retarding roller in said direction with a predetermined torque, said latter rotating means including a resilient torsion element, means for maintaining a predetermined minimum angular deflection of said torsion element, means for coupling one end of said torsion element to said retarding roller, means for irrotatably supporting the other end of said torsion element, and means responsive to a predetermined angular deflection of said torsion element in excess of said minimum deflection for disengaging one of said coupling means and said irrotatable supporting means.

5. Sheet feeding apparatus including in combination a feed roller, means for rotating the feed roller in a certain direction, a retarding roller, means mounting one of said rollers for movement into and out of engagement with the other of said rollers, and means for tending to rotate the retarding roller in said direction with a predetermined torque, said latter rotating means including a first rotary clutch member, a second rotary clutch member, a helical coil spring surrounding said second member having a first and a second end, said spring winding upon and gripping said second member when rotated in a certain direction relative thereto, means including a resilient torsion element for coupling said first member to the first end of said spring, means for maintaining a predetermined minimum angular deflection of said torsion element, means responsive to a predetermined angular deflection of said torsion element in excess of said minimum deflection for intercepting said second end and unwinding said spring, means for coupling said retarding roller to one of said first and second clutch members, and means for irrotatably supporting the other of said first and second clutch members.

* * * * *